US011602763B2

(12) United States Patent
Fliess et al.

(10) Patent No.: US 11,602,763 B2
(45) Date of Patent: Mar. 14, 2023

(54) DOSING SYSTEM WITH DOSING MATERIAL COOLING DEVICE

(71) Applicant: VERMES MICRODISPENSING GMBH, Holzkirchen (DE)

(72) Inventors: Mario Fliess, Munich (DE); Thomas Ginzel, Kreuth-Weissach (DE)

(73) Assignee: VERMES MICRODISPENSING GMBH, Holzkirchen (DE)

( * ) Notice: Subject to any disclaimer, the term of this patent is extended or adjusted under 35 U.S.C. 154(b) by 0 days.

(21) Appl. No.: 17/278,616

(22) PCT Filed: Sep. 24, 2019

(86) PCT No.: PCT/EP2019/075645
§ 371 (c)(1),
(2) Date: Mar. 22, 2021

(87) PCT Pub. No.: WO2020/069910
PCT Pub. Date: Apr. 9, 2020

(65) Prior Publication Data

US 2022/0040725 A1 Feb. 10, 2022

(30) Foreign Application Priority Data

Oct. 5, 2018 (DE) ..... 10 2018 124 663.3

(51) Int. Cl.
*B05C 5/02* (2006.01)
*B05C 5/00* (2006.01)
(Continued)

(52) U.S. Cl.
CPC ..... *B05C 5/001* (2013.01); *B05C 5/0225* (2013.01); *B05C 11/1042* (2013.01); *B05D 1/26* (2013.01)

(58) Field of Classification Search
CPC ..... B05C 5/0225
See application file for complete search history.

(56) References Cited

U.S. PATENT DOCUMENTS 10,350,622 B2 7/2019 Schwab
2004/0029980 A1 2/2004 Stumphauzer et al.
2005/0001869 A1* 1/2005 Abernathy ..... G05D 7/0629 347/17
(Continued)

FOREIGN PATENT DOCUMENTS

CN 103140628 A 6/2013
CN 106207025 A 12/2016
(Continued)

OTHER PUBLICATIONS

International Search Report issued in PCT/EP2019/075645; dated Jan. 30, 2020.
(Continued)

*Primary Examiner* — Jeremy Carroll
(74) *Attorney, Agent, or Firm* — Studebaker & Brackett PC

(57) ABSTRACT

The invention relates to a dosing system (1) for a dosing material having a dosing device (5) with a housing (11), the housing (11) comprising a feed channel (80) for dosing material, a nozzle (40), a discharge element (31) and an actuator unit (10) coupled to the discharge element (31) and/or the nozzle (40). The dosing device (5) further comprises a dosing material reservoir (70) which is coupled to the housing (11) or integrated into the housing (11). The dosing system (1) has a plurality of temperature control devices (2, 2', 2") which are each assigned to different temperature zones (6, 6', 6") of the dosing system (1) in order to control the temperature zones (6, 6', 6") differently. At least one first temperature zone (6) is assigned to the dosing material reservoir (70) and at least one second temperature zone (6") is assigned to the nozzle (40). Preferably, at least one of the temperature control devices (2, 2', 2"), preferably at least the temperature control device (2) assigned to the dosing material reservoir (6), comprises a
(Continued)

Figure 1:
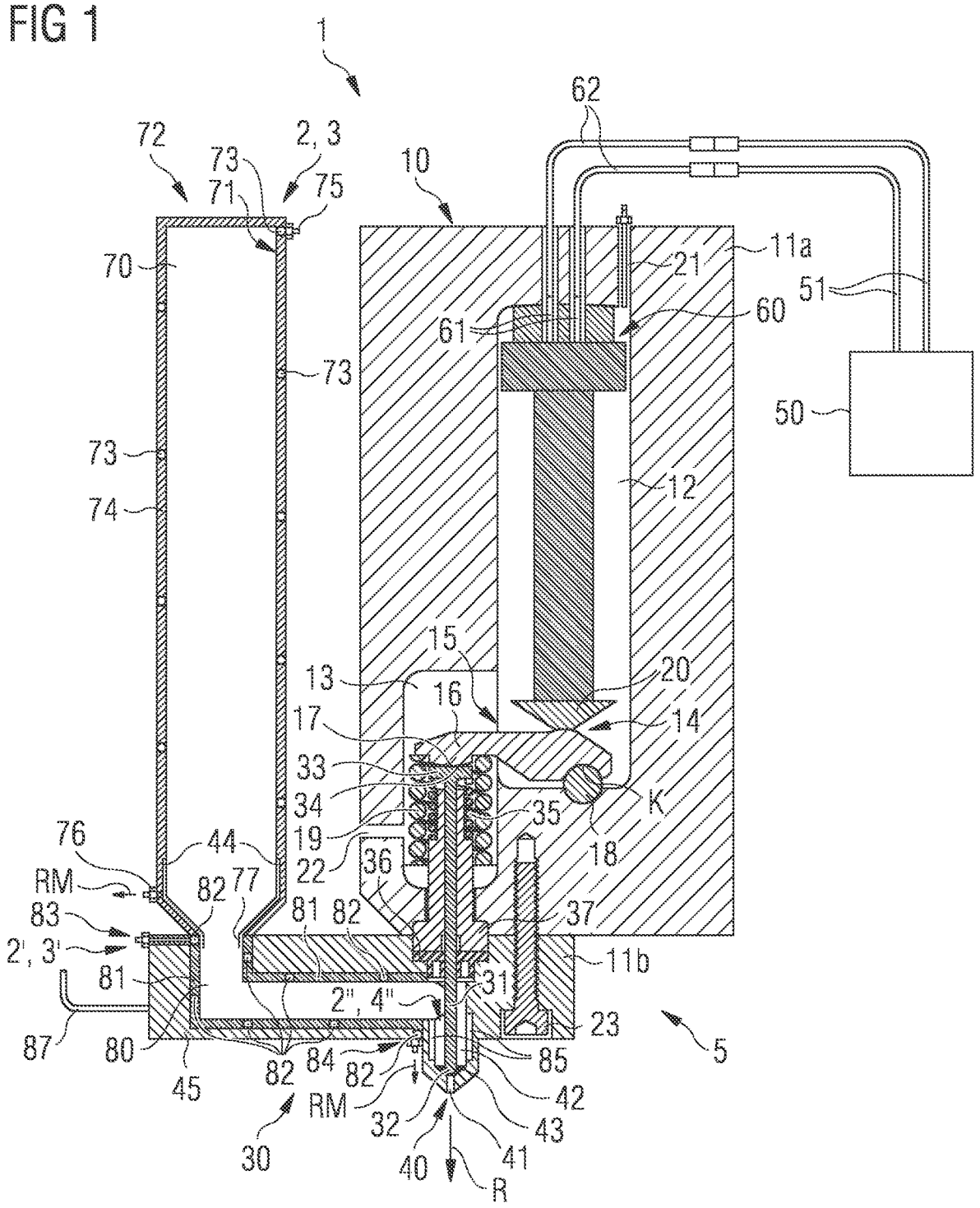

cooling device (3, 3', 3") having a cold source (93, 93', 95, 99).

13 Claims, 4 Drawing Sheets

(51) Int. Cl.
*B05C 11/10* (2006.01)
*B05D 1/26* (2006.01)

(56) References Cited

U.S. PATENT DOCUMENTS

| | | | | |
|---|---|---|---|---|
| 2006/0157517 | A1* | 7/2006 | Fiske | B05C 5/0225 222/504 |
| 2008/0099508 | A1* | 5/2008 | Son | B05C 5/0225 222/394 |
| 2015/0328654 | A1 | 11/2015 | Schwab | |
| 2017/0120280 | A1 | 5/2017 | Hong | |

FOREIGN PATENT DOCUMENTS

| | | | | |
|---|---|---|---|---|
| CN | 106733493 | A | 5/2017 | |
| CN | 107017183 | A | 8/2017 | |
| DE | 202006014586 | U1 | 3/2008 | |
| DE | 102016006363 | B3 | 5/2017 | |
| DE | 102016006364 | A1 | 11/2017 | |
| DE | 102017003020 | A1 * | 10/2018 | B05C 11/1042 |
| DE | 102017003020 | A1 | 10/2018 | |
| WO | 2017213920 | A1 | 12/2017 | |
| WO | WO-2017213920 | A1 * | 12/2017 | |

OTHER PUBLICATIONS

An Office Action mailed by China National Intellectual Property Administration dated Jul. 5, 2022, which corresponds to Chinese Patent Application No. 201980062162.9 and is related to U.S. Appl. No. 17/278,616; with English language translation.

* cited by examiner

DOSING SYSTEM WITH DOSING MATERIAL COOLING DEVICE

The invention relates to a dosing system for a dosing material having a dosing device with a housing, comprising a feed channel for dosing material, a nozzle, a discharge element and an actuator unit coupled to the discharge element and/or the nozzle, and a dosing material reservoir coupled to the housing or integrated into the housing. The invention also relates to a method for operating a dosing system.

Dosing systems of the type mentioned at the outset are typically used to apply a medium to be dosed to a target surface in a targeted manner. In the context of so-called "microdosing technology", it is often necessary for very small amounts of a dosing material to be placed on the target surface with pinpoint accuracy and indeed without touching, that is, without direct contact between the dosing system and a target surface. Such a contactless method is often referred to as a "jet process". A typical example of this is the dosing of glue dots, soldering pastes etc. when assembling circuit boards or other electronic elements, or the application of converter materials for LEDs.

An essential requirement here is to deliver the dosing materials to the target surface with high precision, that is, at the right time, at the right place and in a precisely dosed amount. This can be done, for example, by dispensing the dosing material drop by drop via a nozzle of the dosing system. The medium only comes into contact with an interior of the nozzle and a, mostly front, region of a discharge element of the dosing system. A preferred method here is a discharge of individual droplets in a kind of "inkjet process", as is also used, among other things, in inkjet printers. The size of the droplets or the amount of medium per droplet can be predetermined as precisely as possible through the structure, activation and the targeted effect of the nozzle achieved thereby. Alternatively, the dosing material can also be sprayed on in a jet.

A movable discharge element can be arranged in the nozzle of the dosing system, for example, a tappet, to dispense the medium from the dosing system. The discharge element can be pushed forward inside the nozzle at a relatively high speed in the direction of a nozzle opening or outlet opening, whereby a drop of the medium is discharged and then withdrawn again.

Alternatively or additionally, the nozzle of the dosing system itself can be moved in a discharge or retraction direction. To dispense the dosing material, the nozzle and a discharge element arranged inside the nozzle can be moved towards or away from one another in a relative movement, wherein the relative movement can take place either solely through a movement of the outlet opening or the nozzle or at least partially also through a corresponding movement of the discharge element.

Usually, the discharge element can also be brought into a closed position by fixedly connecting it to a sealing seat of the nozzle opening in the nozzle and temporarily remaining there. Depending on the dosing material, the discharge element can also remain in a retracted position, that is, away from the sealing seat, without a drop of the medium emerging from the nozzle ("open inkjet process").

The discharge element and/or the nozzle are typically moved with the aid of an actuator system of the dosing system. Piezo actuators are preferably used, particularly for applications that require extremely fine dosage resolution. However, the present invention can be operated with all common actuator principles, that is, hydraulically, pneumatically and/or electromagnetically operated actuators can also be used in the dosing system.

In order to improve the processing properties of the dosing material and to achieve the highest possible and constant dosing accuracy when dispensing the dosing material, the dosing material is typically heated to a dosing material-specific processing temperature before it is discharged from the nozzle. Particularly, dosing materials having a medium or high viscosity are heated before processing, thus, before discharge, in order to reduce the viscosity and thus improve the quality of the discharge process, or to even keep the amount of dosing material within the scope of permissible fluctuations. A lower viscosity of the dosing material can further have an advantageous effect on the longevity of the dosing system, since the components of the dosing system involved in the discharge are less stressed. Dosing materials having a medium or high viscosity are, for example, adhesives, soldering pastes, casting compounds, heat-conductive pastes, oils, silicones, paints, etc.

In most conventional dosing systems, the dosing material is therefore heated in a targeted manner at least in the nozzle or within a nozzle chamber of the dosing system.

It is true that the dosing accuracy can be improved by heating the dosing material to a processing temperature, even with highly viscous dosing materials. However, it has been shown that this procedure can have a considerable influence on the processability time (pot life) of the dosing materials. The pot life or service life describes the time span between the production or provision of a, preferably multi-component, dosing material and the end of its processability. When the pot life is reached, the material properties of the dosing material can change such that the dosing material can no longer be processed with the desired quality, that is, it becomes unusable. Depending on the chemical composition of the dosing material, an increase in the temperature of the dosing material can lead to a significant reduction in the pot life. This is particularly problematic when processing thermosetting dosing materials, for example, adhesives.

In conventional dosing systems, heating the dosing material to a processing temperature can lead to the dosing material reaching the end of its pot life before processing, thus, before it is discharged from the nozzle. For example, with a "global" heating of the dosing material in the nozzle, the dosing material also in a "waiting region" before the nozzle, for example, in the feed region and possibly even in the dosing material storage, is (also) heated by means of convection starting from the heated nozzle. On the one hand, this can mean that the dosing material that has become unusable must be disposed of ahead of time or a new batch of dosing material must be provided, which is associated with additional costs. On the other hand, far more serious consequences can result from the fact that the dosing material can clog part of the dosing system after the end of its pot life or has to be removed from the dosing system at great expense. Cleaning the dosing system can mean a temporary shutdown of the dosing system and thus unnecessarily increase operating costs.

Furthermore, with conventional dosing systems, external (ambient) conditions of the dosing system can also have a disadvantageous influence on the pot life of the dosing material. Particularly, a high ambient temperature of the dosing system leads to the dosing material being heated from outside the dosing system even in regions of the dosing system that are not already heated directly or indirectly by the dosing system, which can lead to a shortening of the pot life. This is particularly critical with dosing requirements that require a very low throughput of the dosing material. As already mentioned, a shortening of the pot life can prevent the dosing system from operating efficiently and as uninterrupted as possible.

It is therefore an object of the present invention to provide a dosing system for a dosing material and a method for operating such a dosing system with which the disadvantages explained above can be avoided and with which the efficiency of the dosing system is improved.

This object is achieved by a dosing system according to patent claim 1 and a method for operating a dosing system according to patent claim 11.

A dosing system according to the invention for a dosing material comprises a dosing device with an optional multi-part housing, the housing having at least one feed channel for dosing material, a nozzle, a discharge element and an actuator unit coupled to the discharge element and/or the nozzle. In the following, the discharge element is also referred to synonymously as the tappet, without restricting the invention thereto.

The dosing material can be dispensed from the dosing system according to the invention in one of the ways explained at the outset, that is, the dosing system is not restricted to a specific discharge principle. Correspondingly—as is usually the case—a discharge element movable at relatively high speed for discharging the dosing material from the nozzle can be arranged in the nozzle of the dosing system (particularly in the region of the nozzle, for example, shortly before the outlet opening). Alternatively or additionally, as mentioned, an outlet opening of the dosing system according to the invention can be configured to be movable. Nevertheless, for the sake of better understanding, it is assumed in the following that the dosing material is dispensed by means of a movable discharge element, for example, a tappet. However, the invention is not intended to be limited thereto.

The actuator unit of the dosing device can comprise one or more actuators, wherein the respective actuator can be implemented according to one of the actuator principles mentioned at the outset. The invention is described in the following, without being restricted thereto, on the basis of a dosing system having a piezo actuator. Regardless of the specific embodiment, the actuator unit is encased by the housing of the dosing device, it is thus delimited from an ambient atmosphere of the dosing system.

The actuator unit is functionally coupled, at least at times, to the discharge element or the nozzle. The coupling takes place such that the forces and movements exerted by the actuator are passed on to the discharge element or the nozzle such that a desired, preferably vertical, movement of the discharge element and/or the nozzle for dispensing the dosing material from the nozzle results. Depending on the specific actuator principle, the actuator can act on the discharge element directly, that is, without further movement-imparting components. However, the actuator unit of the dosing system can also comprise a movement mechanism in order to transmit the movement or deflection of the (piezo) actuator to the discharge element over a certain distance. The coupling between the actuator and the discharge element or between the movement mechanism and the discharge element is preferably not a fixed coupling. This means that the respective components are preferably not screwed, welded, glued, etc. to one another for coupling.

The components of the dosing device that come into contact with the dosing material, for example, the feed channel, the nozzle and the discharge element, can preferably be combined in a fluidic unit of the dosing device, for example, as a structural unit. The fluidic unit and the actuator unit can preferably be enclosed in respectively separate sub-housings, which can be coupled to one another, preferably without tools, in order to design the dosing device, that is, the housing is then designed in a plurality of parts.

Furthermore, at least one dosing material reservoir is coupled directly to the housing of the dosing device. A dosing material reservoir is to be understood as a region of the dosing system in which fresh dosing material is held or kept ready until processing. The dosing material reservoir can be assembled at least temporarily, particularly when the dosing system is in operation, by means of a coupling or interface of the dosing device on the housing of the dosing device itself. In the case of an aforementioned two-part housing, the coupling can exist with the actuator unit and/or the fluidic unit. The coupling point, however, is particularly preferably arranged in a region of the fluidic unit. This means that the dosing material reservoir and the dosing device can be "movement-connected" at least temporarily to form a unit.

Alternatively, the dosing material reservoir can also be integrated, preferably fixedly, into the housing of the dosing device. For this purpose, the housing, for example, in the case of a multi-part housing, preferably in the region of the fluidic unit, can have a cavity accessible from outside the dosing system for receiving or storing dosing material. The dosing material reservoir can also be implemented by means of a "dosing material tank" which is located externally or outside the housing and is fixedly connected thereto. Regardless of the specific embodiment of the dosing material reservoir, the dosing system according to the invention thus comprises at least one dosing device with a housing as explained at the outset and a dosing material reservoir that can be coupled on site to form a structural unit or is integrated into the housing.

According to the invention, the dosing system also has a plurality of separately activatable temperature control devices which are each assigned to different defined temperature zones of the dosing system in order to control the respective temperature zones differently. The dosing system comprises at least two, preferably at least three, separate temperature zones.

A temperature zone is understood to mean a limited, defined (sub) region or a section of the dosing system, preferably a cavity of the dosing system that is filled with dosing material. This can contain a dosing material having a specific (target) temperature and/or a specific (target) viscosity. A temperature zone thus comprises at least one controllable dosing material volume in a defined region of the housing and/or the dosing material reservoir. In addition, a temperature zone can preferably also comprise segments of the dosing system that enclose the dosing material volume or limit it to regions of the dosing system lying outside the temperature zone, for example, a number of walls or housing sections.

The respective temperature control devices are configured to control the temperature of the dosing material, which is contained in the respectively assigned subregions of the dosing system, thus, in the temperature zones, or interacts therewith, to different (target) temperatures, for example, to achieve different (target) viscosities of the dosing material.

It is true that (solid) components of the dosing system can necessarily (also) be controlled by means of the temperature control devices. However, the aim of the temperature control is to set the dosing material in two or more defined regions of the dosing system, thus, in a plurality of temperature zones, to different temperatures or viscosities simultaneously by means of the respective temperature control devices.

The temperature control takes place during operation of the dosing system, thus, while the dosing material flows through a respective temperature zone or is arranged therein. For this purpose, the temperature control devices are configured and arranged in the dosing system such that each temperature control device can control an individual specific (assigned) temperature zone, particularly the dosing material therein.

In the context of the invention, temperature control is to be understood as feeding thermal energy into or removing thermal energy from the dosing material. Both processes can optionally also run simultaneously. For this purpose, the individual temperature control devices can each comprise at least one heating device and one cooling device, wherein the temperature a able to be controlled by means of conduction and/or convection, as is explained later. The heating device and the cooling device of a respective temperature control device can preferably be activated separately by means of separate control and/or regulating circuits of a control and/or regulating unit of the dosing system. This is also explained in detail later.

According to the invention, at least one first temperature zone is assigned to the dosing material reservoir, wherein a second temperature zone is assigned to the nozzle. The nozzle can preferably have a (hollow) interior space which is filled with dosing material and which is referred to as a nozzle chamber. The second temperature zone can preferably be assigned to the nozzle chamber. This means that the temperature control devices are configured to control the temperature of the dosing material differently, preferably lower, in at least one region of the dosing material reservoir, than in a region of the nozzle, particularly differently than in a nozzle chamber of the nozzle. The two temperature zones are preferably separated from one another by a feed region or feed channel for dosing material, that is, they are preferably not directly adjacent to one another.

According to the invention, at least one of the temperature control devices, preferably at least the temperature control device assigned to the dosing material reservoir, comprises a cooling device having at least one cold source. The cold source is preferably configured to actively dissipate thermal energy from a substance in order to bring about a specific cooling capacity. The cold source can carry out a cooling process, that is, it can actively "generate" cold. In physical terms, the cold source can also be understood as a heat sink.

The cold source is configured and interacts with the cooling device such that the cooling device can use the cold "generated" by the cold source to cool the dosing material. Depending on the embodiment, the cold source itself can substantially form the entire cooling device. Alternatively or additionally, however, the cold source can also be coupled to the cooling device, as is explained at a later point in time.

The cooling device is configured to cool the assigned temperature zone, particularly the dosing material in the temperature zone, to a specific (target) temperature. For cooling purposes, heat or thermal energy can be withdrawn from the dosing material in a targeted manner by means of the cooling device, for example, by means of convection and/or conduction. The dosing material can particularly be cooled by means of the cooling device to a temperature significantly below the ambient temperature of the dosing system. The dosing material in the temperature zone can preferably be controlled to a (target) temperature of at most 18° C., preferably at most 3° C., particularly preferably at most −30° C., by means of the assigned temperature control device, particularly the cooling device.

The implementation according to the invention having a plurality of temperature control devices for different temperature zones has several advantages:

On the one hand, the dosing system according to the invention can be used to achieve a high level of precision in the dispensing of the dosing material, in that the dosing material in the region of the nozzle can be controlled to an optimal processing temperature by means of an assigned temperature control device.

On the other hand, the dosing material in the region of the dosing material reservoir can be cooled to a significantly lower temperature than the processing temperature, for example, a storage temperature, in order to keep the dosing material stable in the dosing system over a longer period of time. Advantageously, the dosing material in the dosing material reservoir can be cooled so that the dosing material reaches the nozzle having an uncritical (target) temperature and is only brought to the processing temperature shortly before discharge from the nozzle, thus, in the nozzle itself, for example, to achieve a suitable viscosity for discharging the dosing material. This allows the disadvantageous effect of a (high) processing temperature on the processability of the dosing material to be reduced as far as possible, which improves the efficiency of the dosing system. An undesired shortening of the pot life can particularly be effectively counteracted even at high ambient temperatures and/or a low dosing material throughput.

A method according to the invention for operating a dosing system for the dosing of dosing material relates to a dosing system having a dosing device optionally also having multi-part housing, the housing comprising at least one feed channel for dosing material, a nozzle, a discharge element and an actuator unit coupled to the discharge element and/or the nozzle. The dosing system further has a dosing material reservoir which is coupled directly to the housing or is integrated into the housing.

According to the invention, a plurality of defined temperature zones of the dosing system is controlled differently by means of a plurality of separately activatable temperature control devices of the dosing system, wherein a temperature control device is assigned to each temperature zone. The temperature control devices can be activated and/or regulated separately by means of a control and/or regulating unit of the dosing system for the respective control of the temperature zones, particularly the dosing material in the respective temperature zones.

According to the invention, at least two, preferably at least three, temperature zones of the dosing system are controlled differently by means of a respectively assigned temperature control device. In the method according to the invention, at least one first temperature zone assigned to the dosing material reservoir is controlled differently than a second temperature zone assigned to the nozzle.

Preferably, at least one of the temperature zones, preferably at least the temperature zone assigned to the dosing material reservoir, is controlled by means of a cooling device (using a cold source) of the assigned temperature control device.

Further, particularly advantageous embodiments and developments of the invention emerge from the dependent claims and the following description, wherein the independent claims of one claim category can also be developed analogously to the dependent claims and embodiments of another claim category and particularly individual features of various embodiments or variants can also be combined into new embodiments or variants.

The dosing system preferably comprises at least one further separately activatable temperature control device which is assigned to a third temperature zone of the dosing system. The third temperature zone is preferably assigned to the feed channel of the dosing system in order to control the dosing material in the feed channel to a (target) temperature, wherein the (target) temperature can differ from a respective (target) temperature of the dosing material in the dosing material reservoir and/or the nozzle. The temperature control devices of the dosing system are preferably configured to set a "temperature gradient" of the dosing material in different regions of the dosing system in a targeted manner, as is explained later.

The temperature control device assigned to the feed channel preferably also comprises a cooling device having a cold source as described at the outset. Likewise, the temperature control device assigned to the nozzle can also comprise such a cooling device having a cold source. The individual cooling devices are preferably configured to be separately activatable.

The feed channel or feed region is understood to be a (sub) region of the dosing system which extends from the dosing material reservoir to the nozzle. In contrast to the dosing material reservoir (except when the dosing system is shutdown), the feed channel does not represent a significant (long-term) storage medium for dosing material, but rather new dosing material more or less continuously flows through during operation. The feed channel can preferably extend between a coupling point for a couplable dosing material reservoir and the inside of a nozzle or the beginning of a nozzle chamber of the nozzle.

In a particularly preferred embodiment of the dosing system, the dosing system can thus comprise three temperature zones to be differently controlled. A respective temperature zone can preferably completely include a closed active unit or a functional component of the dosing system, thus, for example, the entire dosing material reservoir. Particularly preferably, the respective temperature control devices can therefore be designed or assigned to the respective temperature zones in order to control "predominantly" uniformly substantially all of the dosing material in the dosing material reservoir, or substantially all of the dosing material in the feed channel or substantially all of the dosing material in the nozzle.

The respective temperature zones can preferably directly adjoin one another or follow one another without interruption. A boundary between two temperature zones represents a temperature transition region. This means that the dosing material is not controlled to a new (target) temperature suddenly after it has passed a temperature zone boundary, but instead assumes this temperature as it continuously flows through it. "Predominantly" uniformly controlled means that there can be regions of a temperature zone, for example, in the region of a temperature zone boundary in which the dosing material does not (yet) have a corresponding (target) temperature.

Advantageously, by means of a third temperature control device of the dosing system, it is possible to keep the dosing material reliably in a respectively desired or advantageous (target) temperature range from the time it is made available (in the dosing material reservoir) until it is actually processed (in the nozzle). Advantageously, on the one hand, the dosing material can be kept continuously below the processing temperature of the dosing material even with a very low dosing material throughput until it reaches the nozzle, wherein a shortening of the pot life can be effectively counteracted. This is particularly advantageous when processing thermosetting dosing materials, for example, adhesives.

However, on the other hand, the third, separately controllable temperature control device can also be used to gradually bring the dosing material to a processing temperature. In the case of a very high dosing material throughput, it can be advantageous to control the dosing material emerging from the dosing material reservoir and possibly very cold in the feed channel to a new, higher (target) temperature (but below the processing temperature) by means of the assigned temperature control device. The feed channel can therefore be used for "pre-control" of the dosing material in order to reduce a temperature difference between the dosing material emerging from the dosing material reservoir and the processing temperature. This makes it possible, despite a high dosing material throughput, to control the dosing material to a processing temperature in the nozzle itself, so that the exposure time of the dosing material to a (high) processing temperature and the thereby resulting undesirable effects can be kept as short as possible.

In the context of the invention, it is also possible for the respective temperature zones to not directly adjoin one another, that is, there can be "gaps" between the controlled temperature zones. The dosing system can comprise (sub) regions to which no temperature control device is assigned. Correspondingly, the temperature control devices can be configured to control the dosing material only in at least a local subregion of the dosing material reservoir or the feed channel or the nozzle, wherein other regions of the aforementioned components are not (directly) affected by the temperature control. For example, the dosing material in the cartridge could be actively cooled in order to maximize the pot life and then only actively controlled again in the nozzle in order to enable the dosing material to be processed.

Each temperature control device of the dosing system can comprise a separately activatable cooling device to cool the dosing material. As already mentioned, the individual cooling devices use the cold provided by a cold source.

According to a first embodiment of the cooling device, it is possible for the cold source to be configured as an essential component of the cooling device. This means that the cooling device and the cold source can design a unit, which is preferably fixedly connected. The cooling device can then be configured to cool the dosing material of an assigned temperature zone to a (target) temperature in a contact-reliant manner, thus, without using a flowing cooling fluid, for example, by means of conduction. The cold source can preferably make use of the principle of thermoelectric cooling. According to this embodiment, each cooling device can preferably comprise at least one (separate) cold source.

For example, a cooling device can comprise at least one Peltier element (as a cold source), which is arranged on the housing or on the dosing material reservoir by means of a holding device (as part of the cooling device) in order to feed the dosing material to an assigned temperature zone with as little loss as possible.

According to a second embodiment of the cooling device, it is possible for a single cold source to be able to interact with a plurality of, preferably all, cooling devices of a dosing system.

The cold source can then preferably be coupled (detachably) to a plurality of separately activatable sub-cooling circuits. The cold source can preferably be in operative contact with at least two, preferably with at least three, sub-cooling circuits that are to be operated separately.

Each of these separately activatable sub-cooling circuits is preferably configured to control the temperature of the dosing material in a specific temperature zone. This means that a sub-cooling circuit is assigned to a specific temperature zone. A sub-cooling circuit can thus form the cooling device of an assigned temperature zone.

A respective sub-cooling circuit preferably comprises a number of cooling components or a "cooling element", which is preferably arranged in a region of the housing or the dosing material reservoir. A sub-cooling circuit is preferably configured to supply the "cooling element" with a flowing gaseous and/or liquid precooled cooling medium at a specific (target) temperature. A respective "cooling element" can preferably be configured in the manner of a heat exchanger in order to transfer the cold from the precooled cooling medium to the dosing material as efficiently as possible or to remove heat accordingly.

A respective "cooling element" preferably comprises at least one feed opening for a precooled cooling medium, for example, a coupling point for an external cooling medium supply line. To design a sub-cooling circuit, the "cooling element" of a respective cooling device can be be coupled to the cold source by means of a separate cooling medium supply line, for example, a temperature-insulated flexible line. In addition, the "cooling element" can comprise an outlet opening for the cooling medium, for example, a coupling point for a separate cooling medium discharge line in order to feed the cold source with the optionally warmed cooling medium.

The plurality of sub-cooling circuits is therefore preferably configured to participate in the cold of a jointly used cold source. The cold source is preferably configured for this purpose and can be activated in such a way in order to selectively feed the individual subcooling circuits with a cooled cooling medium at different temperatures.

To control the cooling capacity of a respective cooling device, the (target) temperature of the cooling medium flowing into the cooling device can be controlled by means of a control unit of the dosing system. Alternatively or additionally, a volume flow of the cooling medium can be controlled in a respective sub-cooling circuit, for example, by means of a separately activatable proportional valve and/or a pump.

In the following description, the dosing system is described on the basis of a cooling device according to the second embodiment, wherein a jointly used cold source supplies a plurality of sub-cooling circuits with cold. However, the invention is not intended to be limited thereto.

The cold source is preferably configured to cool a gaseous and/or liquid cooling medium to a specific (target) temperature, thus, to extract heat or thermal energy from the cooling medium in a targeted manner. As a result of the active cooling, the (target) temperature of the cooling medium can preferably be lower than an ambient temperature of the dosing system. The cooling medium can be cooled by means of the cold source so that it has a (target) temperature of at most 18° C., preferably at most 3° C., particularly preferably at most −30° C., in the region of the respective temperature control device.

The cold source, which can also be referred to as a "cold generating device", can be configured separately, thus, not as an integral part of the dosing system. For example, the cold source can be arranged "remote" from the dosing system, wherein the cooling devices are supplied with cooling medium by means of separate cold transfer devices, for example, separate cooling medium supply lines.

According to a first embodiment, the cold source can preferably be operated regardless of the temperature and/or humidity of the ambient air of the dosing system or the cold generating device. This means that the temperature of the cooling medium can not only be reduced relative to an ambient temperature by means of the cold source, but can also be set to "any" value, that is, what is required with regard to the operation of the dosing system. The cold source can preferably make use of the principle of a refrigeration machine. For example, the cold source could comprise a compression refrigeration system. Such a refrigeration machine can preferably be configured to supply a plurality of temperature control devices, optionally also from different dosing systems, with precooled cooling medium. Liquid and/or gaseous media are suitable as the cooling medium, wherein cooling media having a high thermal capacity are preferred.

Compressed and (actively) cooled air can preferably be used as the cooling medium, since this can be provided with relatively little effort and can be compatible with the hygroscopic properties of live piezo actuators. The cold source can therefore be implemented by means of at least one vortex tube in a second embodiment of the invention. The vortex tube is configured to cool the cooling medium down to a specific (target) temperature.

The cooling device can preferably also comprise more than one, thus, at least two, cold sources. Particularly, the plurality of cold sources can be configured to be separately activatable. If the cold used by a cooling device is generated by means of two or more separate "cold generating" components (cold sources), the term "multi-part" cold source is used in the following.

For example, a multi-part cold source can be implemented by means of a plurality of vortex tubes. Preferably, a vortex tube can supply an individual sub-cooling circuit with precooled cooling medium.

The temperature of the cooled air emerging from the respective vortex tube can preferably be regulated by means of an adjustable regulating valve in the region of a hot air outlet of the vortex tube. Alternatively or additionally, a volume flow of the air flowing into a vortex chamber of the vortex tube can also be adapted, for example, by means of a proportional valve upstream of the vortex tube.

According to a third embodiment, the cold source can particularly preferably comprise a refrigeration machine, for example, a compression refrigeration system, and at least one cooperating downstream vortex tube (multi-part cold source). Preferably, a cooling medium that has already been previously controlled or cooled can be finally cooled to a (target) temperature by means of the vortex tube. As a result of this interaction, the cooling mediurn can also be cooled to temperatures below the "lowest possible" cooling temperature of a refrigeration machine. In this embodiment, too, a vortex tube (downstream) can preferably interact with a respective sub-cooling circuit.

Advantageously, a sufficiently large amount of a sufficiently cooled cooling medium is always provided by means of the cold source in order to cool the dosing material in one or a plurality of temperature zones to specific (target) values. This allows the dosing material to be kept stable in the dosing system over a longer period of time, even under unfavorable ambient conditions, for example, at high air temperatures. A very wide or deep control range for cooling the dosing material can particularly be achieved when a cold compression length interacts with a (downstream) vortex tube.

Furthermore, a multi-part cold source having a plurality of, thus, two or more, (downstream) vortex tubes advantageously enables a cooling medium to be fed to the individual cooling devices at different temperatures, particularly the sub-cooling circuits. As a result, the control of the respective temperature zones can also be optimally adapted to dynamic dosing requirements, as is explained later.

In the context of the invention, the cold source can, as explained previously, also be fixedly coupled to the cooling device, for example, by means of a Peltier element arranged on or in the housing. Such an embodiment of the cold source is, for example, advantageous when a selective or locally limited cooling effect is required. For example, a region of the nozzle pointing in the direction of the actuator unit and/or an outer region of the nozzle or the housing can be cooled in a targeted manner.

The temperature control devices can each comprise a heating device in order to adapt the temperature of the dosing material in the dosing system as dynamically as possible to a current dosing requirement. The temperature control device assigned to the dosing material reservoir and/or the feed channel and/or the nozzle can respectively have at least one heating device in order to heat the dosing material to a specific (target) temperature in the respectively assigned temperature zone.

The cooling device and the heating device of the respective temperature control devices can preferably be configured to be separately activatable. The two components are preferably designed spatially separate from one another, particularly by means of separate elements. The heating device and the cooling device can particularly preferably use different (control) media to control the temperature of the dosing material.

The respective cooling devices and the heating devices are preferably arranged in the dosing system such that the dosing material can be brought to a (target) temperature as efficiently as possible in an assigned temperature zone. The cooling device and the heating device of a respective temperature control device are preferably in operative contact with the dosing material of the respectively assigned temperature zone.

The respective heating device can be implemented by means of at least one electrically heatable element, for example, a heating wire and/or a heating cartridge in a region of the housing or the nozzle. The temperature of the dosing material is controlled by means of conduction, thus, without direct contact between the heating device and the dosing material.

Depending on the dosing material, it can be advantageous to also heat the dosing material in the region of the dosing material reservoir. On the one hand, the dosing material reservoir can, as said, be arranged fixedly in a region of the housing. On the other hand, the dosing material reservoir can comprise a dosing material supply container coupled to the housing.

The dosing material reservoir can preferably be implemented by means of at least one dosing material storage container. The dosing material storage container, which is also referred to as a dosing material cartridge, can preferably be assembled directly on the housing at least temporarily. The dosing material cartridge can particularly preferably comprise a cartridge coupling point in order to fasten the entire cartridge reversibly to the coupling point of the housing.

In order to effectively cool the dosing material in the cartridge or in the coupled dosing material reservoir, cooling medium could stream against or blow upon the cartridge from outside by means of the assigned cooling device. Preferably, however, the dosing system can comprise a "cartridge receiving unit" in which the cartridge is completely received in the properly assembled state, thus, when the cartridge is coupled to the housing during operation. The cartridge receiving unit is preferably configured to delimit the assembled cartridge from an ambient atmosphere of the dosing system in a substantially airtight manner.

The cartridge receiving unit can preferably comprise at least one closable opening for access to the cartridge and an access opening for the precooled cooling medium or a coupling point for an external cooling medium supply. A flow channel for cooling medium (as a "cooling element") can preferably be designed in the region between the cartridge and a wall of the cartridge receiving unit surrounding the cartridge from the outside. The cartridge receiving unit can furthermore comprise a heating device, for example, in a region of the wall of the cartridge receiving unit facing the cartridge.

In order to control the dosing material in the dosing material reservoir to a specific (target) temperature, the assigned temperature control device can be activated by means of a control unit and/or regulating unit. A respective control unit and/or regulating unit can preferably also be assigned to the other temperature control devices, the control unit and/or regulating unit being configured to control and/or regulate the cooling device and the heating device of the respective temperature control device separately. The dosing system can preferably comprise only one (common) control unit and/or regulating unit or be coupled thereto in order to actuate the respective temperature control devices by means of separate control and/or regulating circuits.

The term control is used in the following as a synonym for control and/or regulation. This means that even when one speaks of control, the control can comprise at least one regulating process. In the case of regulation, a control variable (as an actual value) is generally recorded continuously and compared with a reference variable (as a target value). The regulation is usually carried out in such a way that the control variable is approximated to the reference variable. This means that the control variable (actual value) continuously influences itself in the action path of the regulating circuit.

The control unit is preferably configured to control and/or regulate the respective temperature control devices such that the dosing material in the respectively assigned temperature zone is controlled to a respectively predetermined, preferably different, (target) temperature.

A temperature control device can preferably be controlled such that only cooling of the dosing material takes place, that is, only the cooling device is activated.

Alternatively, the control unit can only be used to actuate the heating device of a temperature control device. The heating capacity of the heating device can preferably be controlled for control of the dosing material, thus, for setting and maintaining a (target) temperature of the dosing material, for example, by controlling the strength of electric current supplied to the heating device.

However, the cooling device and the heating device can also be operated in parallel at least at times, that is, the dosing material in the same temperature zone can be cooled and heated simultaneously (principle of "overlapping" regulation). Preferably, the cooling and heating devices can be activated or operated largely independently of one another.

However, it is preferred that when controlling a respective component (cooling or heating device), the current state of the other "opposing" component is taken into account (for example, whether a component is currently "active" or "inactive"). The "overlapping regulation" is preferably controlled such that the consumption of heating energy or cooling medium is as low as possible, that is, the heating device and the cooling device do not continuously work against one another at full load.

Advantageously, using the principle of "overlapping regulation", an "overshooting" of the dosing material temperature above a predetermined (target) temperature can be largely avoided. In addition, a slight, controlled "working against one another" of the heating device and cooling device can contribute to an increased "rigidity" or constancy of the dosing material temperature with respect to external disturbances.

The dosing system is also advantageously suitable for processing hot-gluing dosing agents due to the separately activatable heating and cooling devices, particularly in the region of the dosing material reservoir. Advantageously, a hot-setting adhesive in the region of the dosing material reservoir can initially only be liquefied to such an extent that the dosing material can flow in the dosing system. Only in the nozzle can the viscosity of the hot-setting adhesive be reduced to such an extent (by heating it to a processing temperature) that the dosing material can be discharged from the nozzle. As a result, the energy requirement for heating the dosing material can be reduced with respect to a consistent supply of the dosing material in the dosing system at processing temperature.

The (target) temperatures of the dosing material in the individual temperature zones can preferably be determined within the scope of temperature management of the dosing material. The control unit is preferably configured to calculate and/or carry out a particularly economical temperature management of the dosing material, that is, to activate the individual temperature control devices accordingly. The temperature can preferably be managed such that, on the one hand, optimal processing of the dosing material (during discharge) and, on the other hand, the longest possible pot life of the dosing material in the dosing system is achieved.

In the context of temperature management, the control unit can be configured to control and/or regulate a respective temperature control device for control of the dosing material as a function of at least one input parameter. The individual temperature control devices can be controlled separately, thus, as a function of the same or respectively different input parameters.

The control unit can preferably also be configured to control or determine a (target) temperature of at least one temperature zone as a function of an input parameter.

An input parameter can be stored in the control unit and/or determined by means of a sensor of the dosing system, as is explained in the following. A respective temperature control device can preferably be controlled, particularly regulated, as a function of one or a plurality of input parameters (as an actual value) such that the dosing material in the respectively assigned temperature zone, preferably substantially in the entire temperature zone, reaches a specific (respective) target value as quickly as possible and/or the target value is kept as constant as possible during operation. A target value of the dosing material in the respective temperature zones is preferably kept constant as a result of the regulation even with a high dosing material throughput and/or with dynamic dosing requirements. A target value can, for example, be a (target) temperature and/or a (target) viscosity of the dosing material.

A first input parameter can be a volume flow of the dosing material or a dosing material throughput per unit of time in a temperature zone. A (target) temperature of a temperature zone can preferably be dynamically controlled (determined) as a function of a current and/or expected volume flow of the dosing material in at least one, preferably in the same, temperature zone.

Alternatively or additionally, a temperature of the dosing material in at least one temperature zone can also be an input parameter for the control unit. At least one temperature sensor in the dosing system can preferably be assigned to a respective temperature control device in order to generate an input parameter for controlling the temperature control device.

The dosing system preferably comprises a number of temperature sensors in order to separately determine the temperature of the dosing material in a region of the dosing material reservoir, the feed channel and the nozzle. The respective sensors can be arranged in direct measuring contact with the dosing material. Alternatively, the sensors can be configured to determine or extrapolate the temperature of the dosing material over a certain distance.

A third input parameter can be a viscosity of the dosing material in at least one temperature zone. The (target) temperature of at least one temperature zone can preferably be dynamically controlled (determined) as a function of a viscosity of the dosing material.

To regulate the control, for example, in order to achieve a specific (target) viscosity of the dosing material, the input parameter can be determined separately in the temperature zones by means of a suitable sensor, for example, a viscometer. Alternatively, the (actual) viscosity of the dosing material can also be calculated, for example, by means of a viscosity of the dosing material stored in the control unit (under standard conditions) and the conditions currently prevailing in the dosing material.

Advantageously, by means of the dosing system, particularly by means of the control unit, on the one hand, the individual temperature control devices can be activated in order to achieve a (target) temperature of the dosing material in a respective temperature zone as efficiently as possible.

On the other hand, the (target) temperatures of the respective temperature zones to be achieved, or the dosing material therein, can be continuously redetermined during operation and thus adapted to the current conditions of the dosing process. In this way, external "disruptive factors" (for example, fluctuating ambient temperatures) and/or internal fluctuations in the operating sequence (for example, a strongly varying dosing material throughput) can be largely compensated, wherein an adverse effect on the composition of the dosing material is avoided. This enables particularly high dosing accuracy to be achieved and, simultaneously, counteracts a reduction in pot life.

The previously explained temperature management of the dosing material can preferably also be taken into account in a method for operating the dosing system, as is explained in the following.

In a preferred method, the temperature zone assigned to the nozzle can be controlled by means of the assigned temperature control device such that the temperature of the dosing material in the, preferably substantially entire, temperature zone corresponds to at least a specific processing temperature of the dosing material. The temperature can preferably be controlled such that the temperature of the dosing material is higher than an ambient temperature of the dosing system.

The control of the temperature zone assigned to the dosing material reservoir can preferably be carried out such that the temperature of the dosing material in the, preferably substantially entire, temperature zone is lower than the temperature of the dosing material in the temperature zone assigned to the nozzle or in the nozzle. Alternatively or additionally, temperature can also be controlled such that the temperature of the dosing material in the dosing material reservoir is lower than the ambient temperature of the dosing system.

The control of the temperature zone assigned to the feed channel of the dosing system is preferably carried out such that the temperature of the dosing material in this temperature zone, particularly substantially in the entire feed channel, is higher than the temperature of the dosing material in the temperature zone assigned to the dosing material reservoir or in the dosing material reservoir. Alternatively or additionally, the temperature can also be controlled such that the temperature of the dosing material in the feed channel is lower than the temperature of the dosing material in the temperature zone assigned to the nozzle. In order to control the temperature of the dosing material to a specific (target) temperature in a respective temperature zone, a cooling device and a heating device of a respective assigned temperature control device can be activated separately by means of respectively separately configured control circuits of the control unit.

Particularly preferably, as described above, the respective temperature control devices, thus, the temperature control device assigned to the dosing material reservoir, optionally the temperature control device assigned to the feed channel and the temperature control device assigned to the nozzle, can be controlled separately by means of the control unit so that a defined temperature gradient of the dosing material is formed in the dosing system. The temperature gradient can preferably be formed as a result of the control so that the temperature of the dosing material in the dosing material storage container is lower than the temperature of the dosing material in the feed channel, wherein the temperature in the feed channel is lower than the temperature of the dosing material in the nozzle.

The respective temperature control devices in the method can preferably be controlled such that the dosing material is gradually heated in the course, preferably from a stable storage temperature, to a processing temperature. The control is preferably carried out such that the temperature of the dosing material only matches the processing temperature as briefly as possible, that is, the dosing material is brought to the final processing temperature as late as possible in the method, preferably immediately before the discharge process.

In the context of the temperature management, the (target) temperature of the respective temperature zone of the dosing system, thus, the (target) temperature of the dosing material in the temperature zone assigned to the dosing material reservoir and/or in the temperature zone assigned to the feed channel and/or in the temperature zone assigned to the nozzle, can be determined as a function of an actual and/or expected dosing material throughput in a respective temperature zone by means of the control unit. Particularly, the (target) temperatures can also be dynamically adapted to fluctuations in the dosing material throughput.

Finally, for the sake of completeness, it should be pointed out that the respective temperature control devices can also be configured in order to control the temperature of the temperature zones substantially in the same way. Correspondingly, the control unit can actuate the temperature control devices separately such that the dosing material is kept at substantially the same temperature in the respective temperature zones.

Figure 2:
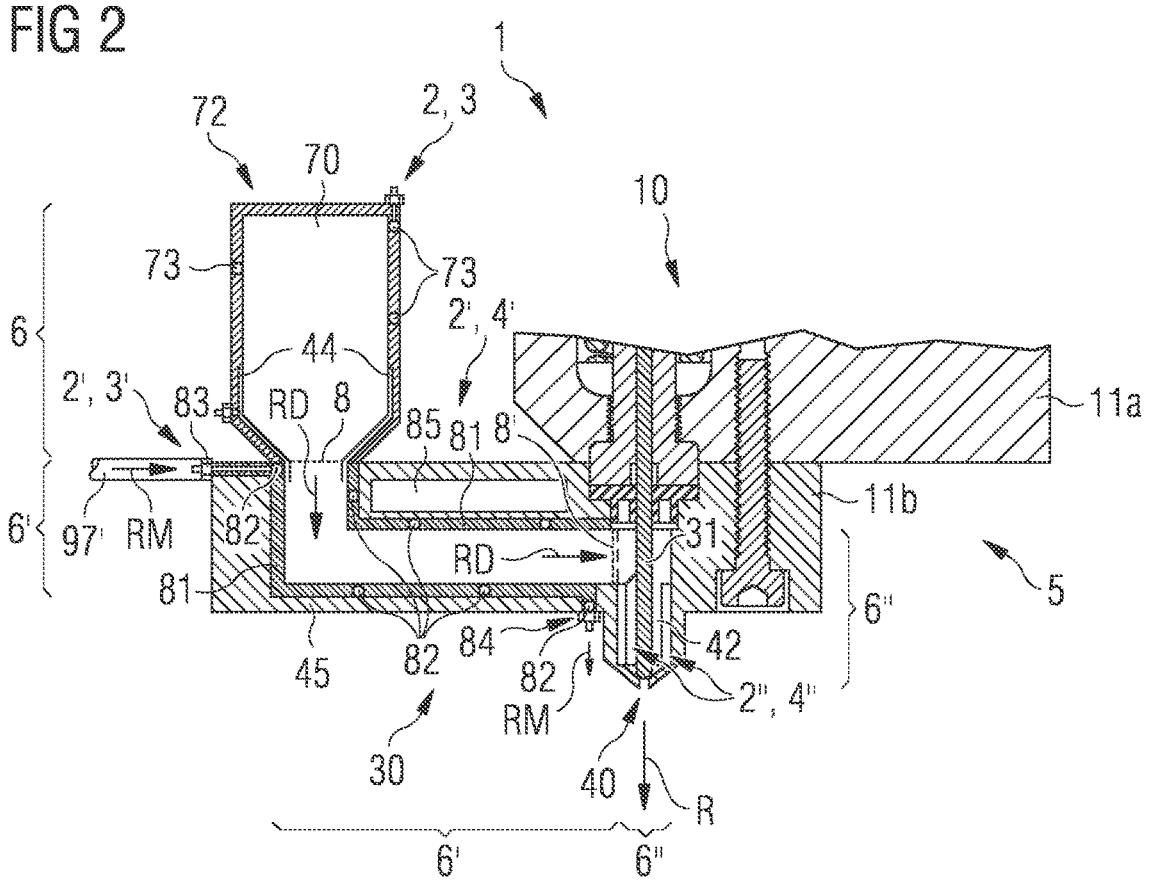
Figure 3:
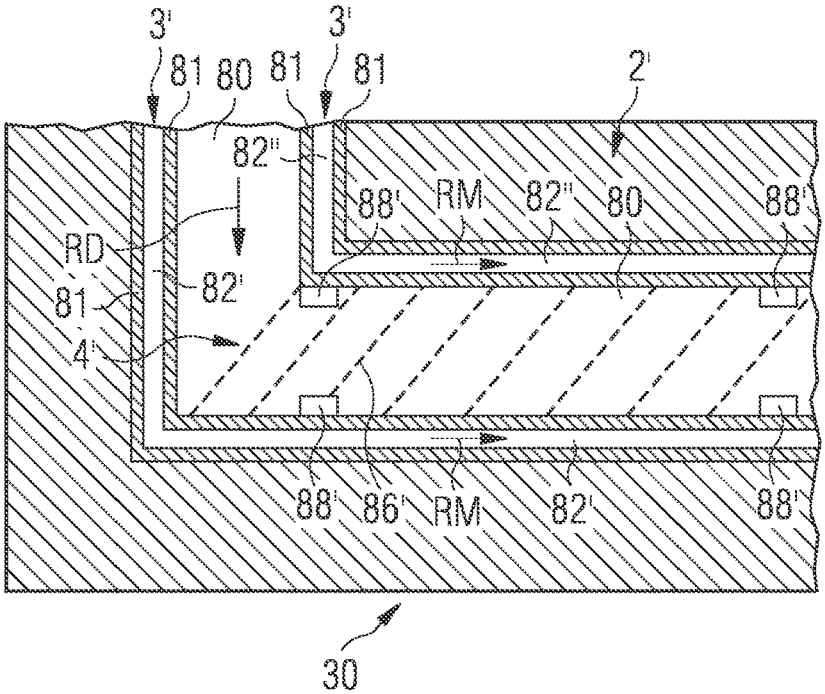
Figure 4:
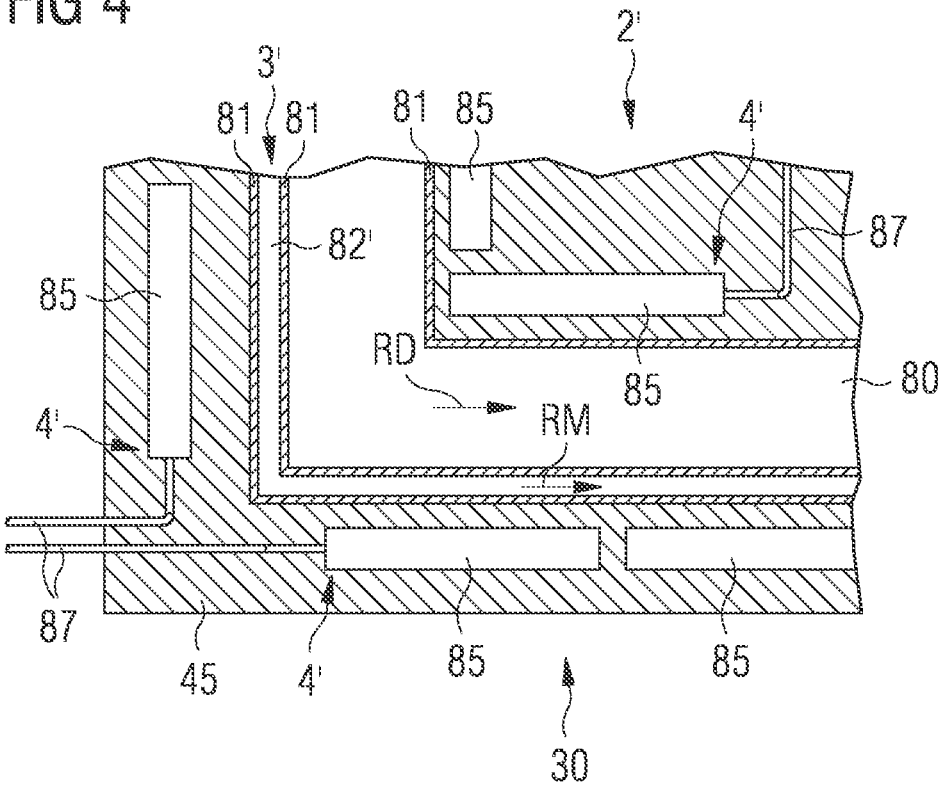
Figure 5:
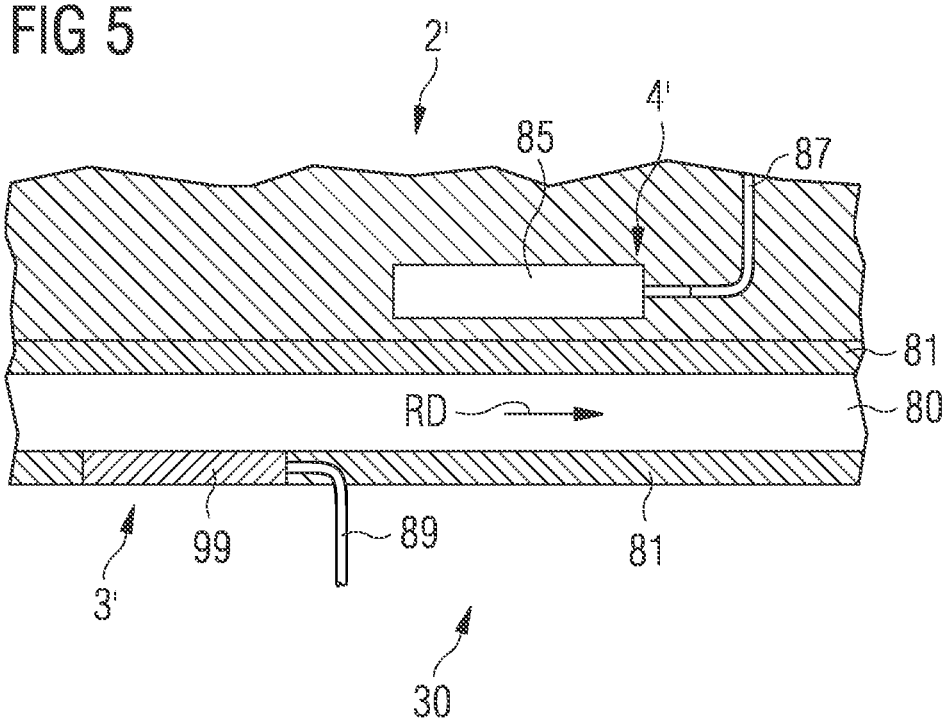
Figure 6:
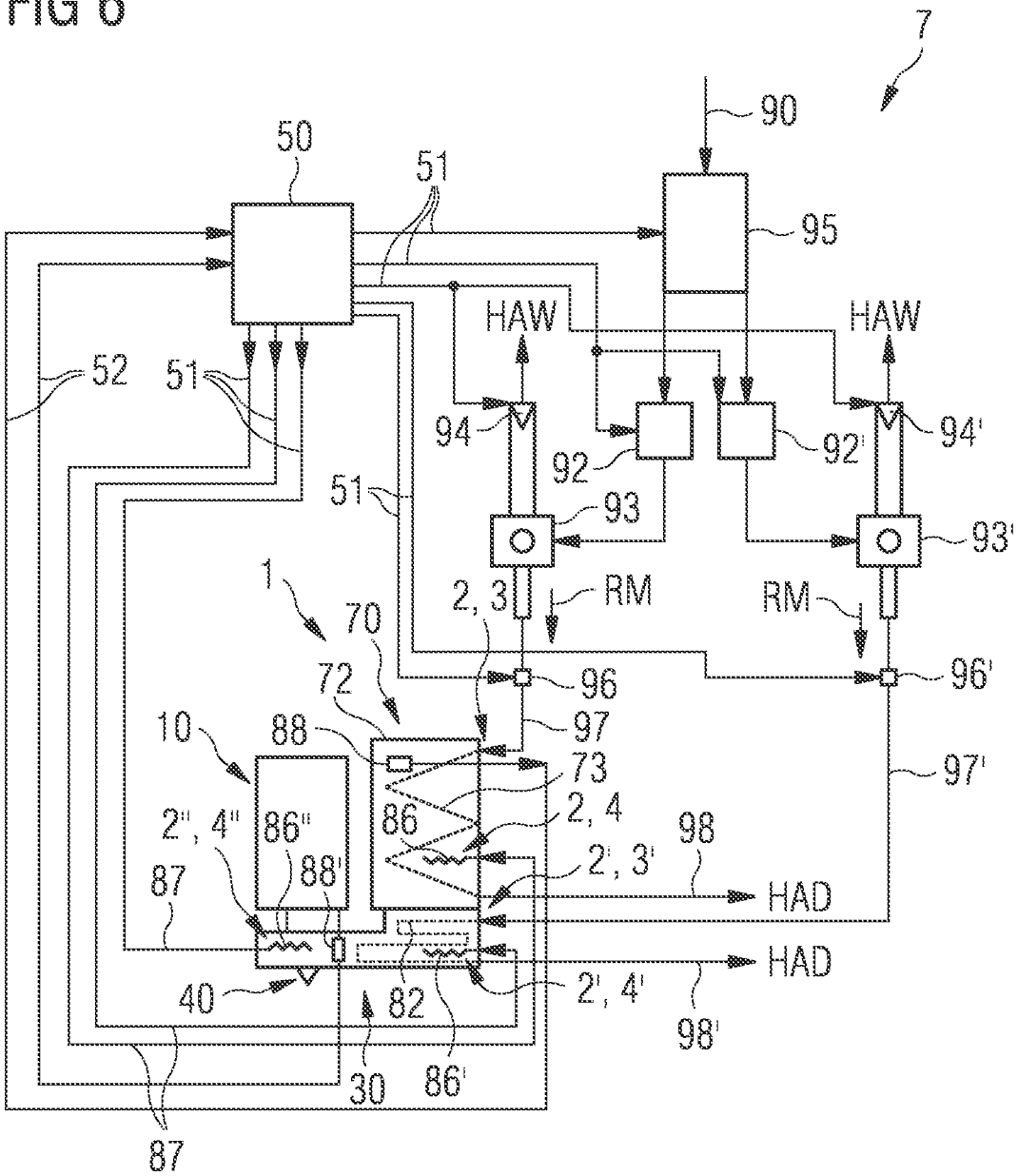

The invention is explained in more detail in the following with reference to the attached figures using embodiments. The same components are provided with identical reference numbers in the various figures. The figures are usually not to scale. Shown are:

FIG. 1 a sectional view of a dosing system according to an embodiment of the invention, FIG. 2 parts of a dosing system according to another embodiment of the invention, FIG. 3 parts of a dosing system according to a further embodiment of the invention, FIG. 4 parts of a dosing system according to a further embodiment of the invention, FIG. 5 parts of a dosing system according to a further embodiment of the invention, FIG. 6 a schematic representation of a temperature control system for a dosing system according to an embodiment of the invention.

A specific embodiment of a dosing system 1 according to the invention is now described with reference to FIG. 1. The dosing system 1 is depicted here in the usual intended location or position, for example, during operation of the dosing system 1. A nozzle 40 is located in the lower region of the dosing system 1, so that the drops of the medium are discharged downwards in a discharge direction R through the nozzle 40. Insofar as the terms below and above are used in the following, these details therefore always relate to such a, usually conventional, position of the dosing system 1. However, this does not rule out that the dosing system 1 can also be used in a different position in special applications and the drops are discharged laterally, for example. This is basically also possible depending on the medium, pressure and exact construction and activation of the entire discharge system.

The dosing system 1 comprises, as essential components, an actuator unit 10 and a fluidic unit 30, which together form a dosing device 5, and a dosing material reservoir 70 coupled to the fluidic unit 30.

In the embodiment of the dosing system 1 shown here, the actuator unit 10 and the fluidic unit 30 are fixedly connected to one another, for example, by means of a fixing screw 23 and thus form a housing 11 having two housing parts 11*a*, 11*b*. It should be noted, however, that the respective assemblies 10, 30 can also be implemented in the manner of plug-in coupling parts that can be coupled to one another to form a quick-release coupling. The actuator unit 10 and the fluidic unit 30 could then be coupled to one another without tools in order to form the dosing system 1. The actuator unit 10 and the fluidic unit 30 together form the dosing device 5 of the dosing system 1.

The actuator unit 10 substantially comprises all components that ensure the drive or movement of a discharge element 31, here a tappet 31, in the nozzle 40, thus, for example, a piezo actuator 60 and a movement mechanism 14 to be able to actuate the discharge element 31 of the fluidic unit 30, a control unit 50 to be able to activate the piezo actuator 60 and similar components, as is explained below.

In addition to the nozzle 40 and a supply line 80 of the medium to the nozzle 40, the fluidic unit 30 comprises all other parts that are in direct contact with the medium, and the elements that are required in order to assemble together the relevant parts which are in contact with the medium or to hold them in their position on the fluidic unit 30.

In the embodiment of the dosing system 1 shown here, the actuator unit 10 comprises an actuator unit housing block 11 a as a first housing part 11 a having two internal chambers, namely, on the one hand, an actuator chamber 12 having a piezo actuator 60 located therein and on the other hand, an action chamber 13 into which the movable discharge element 31, here the tappet 31, of the fluidic unit 30 protrudes. Via a movement mechanism 14, which protrudes from the actuator chamber 12 into the action chamber 13, the tappet 31 is actuated by means of the piezo actuator 60 so that the fluidic unit 30 discharges the medium to be dosed in the desired amount at the desired time. The tappet 31 here closes a nozzle opening 41 and thus also serves as a closure element 31. However, since most of the medium is only discharged from the nozzle opening 41 when the tappet 31 is moving in the closing direction, it is referred to here as the discharge element 31.

The piezo actuator 60 is connected by electricity or signal to a control unit 50 of the dosing system 1 in order to be activated. The connection to this control unit 50 is via control cables 51, which are connected to suitable piezo actuator control connections 62, for example, suitable plugs. The two control connections 62 are each coupled to a contact pin 61 or to a respective connection pole of the piezo actuator 60 in order to activate the piezo actuator 60 by means of the control unit 50. In contrast to what is depicted in FIG. 1, the control connections 62 can be guided through the housing 11 in a sealed manner such that substantially no air can penetrate into the actuator chamber 12 from the outside in the region of the respective control connections 62 carried out, for example, in order to be able to cool the actuator 60 effectively. For this purpose, the actuator chamber 12 comprises a feed opening 21 for a cooling medium in the upper region in order to apply a cooling medium to the piezo actuator 60. The piezo actuator 60, particularly the piezo actuator control connections 62, can, for example, be provided with a suitable memory unit (for example, an EEPROM or the like) in which information such as an article designation etc. or control parameters for the piezo actuator 60 are stored, the control parameters then being able to be read out by the control unit 50 to identify the piezo actuator 60 and activate in the appropriate way. The control cables 51 can comprise a plurality of control lines and data lines. However, since the basic activation of piezo actuators is known, this will not be discussed further.

The piezo actuator 60 can expand and contract again in the longitudinal direction of the actuator chamber 12 in accordance with a wiring by means of the control device 50. The piezo actuator 60 can be inserted into the actuator chamber 12 from above. A spherical cap that is height-adjustable by means of a screwing movement can then serve as the upper abutment (not shown here), allowing precise adjustment of the piezo actuator 60 to a movement mechanism 14, here a lever 16. Accordingly, the piezo actuator 60 is mounted on the lever 16 in the downward direction via a pressure piece 20 which tapers at an acute angle at the bottom and which in turn rests on a lever bearing 18 at the lower end of the actuator chamber 12. The lever 16 can be tilted about a tilt axis K via this lever bearing 18, so that a lever arm of the lever 16 protrudes through a breakthrough 15 into the action chamber 13. The breakthrough 15 connects the action chamber 13 to the actuator chamber 12, so that the cooling medium can flow from the actuator chamber 12 into the action chamber 13 and leave the housing 11 in the region of a discharge opening 22. In the action chamber 13, the lever arm has a contact surface 17 which points in the direction of the tappet 31 of the fluidic unit 30 coupled to the actuator unit 10 and which presses on a contact surface 34 of a tappet head 33.

It should be mentioned at this point that in the embodiment shown, it is provided that the contact surface 17 of the lever 16 is permanently in contact with the contact surface 34 of the tappet head 33, in that a tappet spring 35 presses the tappet head 33 against the lever 16 from below. The lever 16 rests on the tappet 31. However, there is no fixed connection between the two components 16, 31. In principle, however, it would also be possible for the tappet spring 35 to be at a distance between the tappet 31 and lever 16 in an initial or rest position, so that the lever 16 initially travels freely through a specific path section when it is pivoted downwards and thereby picks up speed and then with a high impulse strikes the tappet 31 or its contact surface 34 in order to increase the discharge impulse which the tappet 31 in turn exerts on the medium. In order to enable an almost constant pre-tensioning of the drive system (lever-piezo actuator-movement system), the lever 16 is pressed upwards by an actuator spring 19 at the end at which it comes into contact with the tappet 31.

The fluidic unit 30 comprises a second housing part 11*b* and, as mentioned, is here connected to the actuator unit 10 or its housing part 11*a* by means of a fixing screw 23 to form the housing 11. The tappet 31 is supported by means of the tappet spring 35 on a tappet bearing 37, to which a tappet seal 36 connects downwards. The tappet spring 35 pushes the tappet head 33 away from the tappet bearing 37 in the axial direction upwards. A tappet tip 32 is thus also pushed away from a sealing seat 43 of the nozzle 40. That is, without external pressure from above on the contact surface 34 of the tappet head 31, in the rest position of the tappet spring 35, the tappet tip 32 is located at a distance from the sealing seat 43 of the nozzle 40. Thus, a nozzle opening 41 is also free or not closed in the rest state (non-expanded state) of the piezo actuator 60.

The dosing material is fed to the nozzle 40 via a nozzle chamber 42 to which a feed channel 80 leads. On the other hand, the feed channel 80 is connected to a dosing material reservoir 70, which is implemented here by means of a dosing material cartridge 70. The dosing material cartridge 70 forms the dosing system 1 together with the dosing device 5.

The dosing material cartridge 70 is fastened directly to the housing 11 by means of a coupling point 77 at a coupling point 44 of the housing 11 that interacts therewith, here on the second housing part 11*b*. The interfaces 44, 77 enable a time-saving, preferably tool-free, reversible fastening of the dosing material reservoir 70 to the housing 11. Since the basic structure of dosing systems is known, for the sake of clarity, predominantly those components are shown here which relate at least indirectly to the invention.

The dosing system further comprises three temperature control devices 2, 2', 2", which are each assigned to different temperature zones of the dosing material. A first temperature control device 2 is assigned to the dosing material cartridge 70. The temperature control device 2 comprises a cooling device 3, which is explained in more detail in the following, and a heating device (not shown).

The dosing material cartridge 70 (only shown schematically here) is arranged in the intended state, thus, coupled to the fluidic unit 30, entirely within a cartridge receiving unit 72 of the cooling device 3. The cartridge receiving unit 72 is substantially closed in an airtight manner by means of a cover and comprises a feed opening 75 for a precooled cooling medium, for example, a coupling point for an external cooling medium supply line. A precooled cooling medium can be supplied to a cooling channel 73 by means of the feed opening 75. The cooling channel 73 is arranged here in a wall 74 of the cartridge receiving unit 72 and is configured such that it encloses the cartridge 70 in a substantially helical shape. The cooling channel 73 ends in a discharge opening 76 by means of which the cooling medium can leave the cooling channel 73 again in a flow direction RM. In this embodiment of the cooling device 3, the cartridge receiving unit 72 is initially cooled by means of the cooling medium, and then the dosing material in the cartridge 70 is also cooled indirectly.

In contrast to what is shown here, the first temperature control device could alternatively or additionally also comprise at least one cooling channel running substantially in a straight line, for example, along a longitudinal extension of the cartridge (thus here vertically), in the wall of the cartridge receiving unit. If the cooling device comprises a plurality of separate cooling channels, each cooling channel can comprise a separate feed opening or discharge opening for cooling medium. Alternatively, only one common ("central") feed opening or discharge opening can be assigned to a plurality of separate cooling channels.

In another embodiment of the cooling device (not shown), the cooling channel could be designed between a cartridge wall 71 forming the cartridge and an inner wall of the cartridge receiving unit, thus, in an interior of the cartridge receiving unit, and thus surround the cartridge in a ring shape from the outside.

The dosing material can be controlled substantially in the entire dosing material cartridge 70 up to the entry into the feed channel 80 to a (first) specific (target) temperature by means of the first temperature control device 2.

The dosing system 1 comprises a second temperature control device 2', which is assigned to the feed channel 80. The feed channel 80 can, for example, have a substantially circular cross-section. The second temperature control device 2' also comprises a (separately activatable) cooling device 3' and a heating device (not shown). The cooling device 3' comprises a "cooling element" 82, here a cooling channel 82, which is arranged in a wall 81 of the feed channel 80. The cooling channel 82 winds helically around the entire feed channel 80. This means that both the here vertical subsection (following the cartridge 70) and the following horizontal subsection of the feed channel 80, particularly the dosing material in the respective subsection, are in operative contact with the cooling device 3'.

In order to feed a precooled cooling medium to the cooling channel 82, the "cooling element" 82 comprises a separately (with respect to the feed opening 75 of the cartridge receiving device 72) designed feed opening 83 for precooled cooling medium, which here is connected to the actual cooling channel 82 by means of a short (horizontal) connecting channel. The cooling channel 82 extends as far as a discharge opening 84 for discharging the cooling medium from the cooling channel 82.

In contrast to what is shown here, the second temperature control device could also comprise a plurality of separately configured cooling channels. The individual cooling channels could each comprise separate feed openings or discharge openings or could be coupled by means of only one common ("central") feed or discharge opening. For example, the cooling channels could also be arranged in the fluidic unit at a distance from the feed channel, that is, the respective cooling channels then do not run directly in a wall of the feed channel.

Alternatively, a single cooling channel could also be configured such that it surrounds the feed channel in a ring shape from the outside (when considering a cross-section of the feed channel) and extends along its course.

As mentioned, the second temperature control device 2' comprises a heating device (not shown) which is arranged in a frame part 45 of the housing 11 and can be activated by means of heating connection cables 87. The dosing material can be controlled to a (second) (target) temperature substantially in the entire feed channel 80 by means of the second temperature control device 2'.

A third temperature control device 2" of the dosing system 1 is assigned to the nozzle 40 in order to control the dosing material to a (third) (target) temperature in a nozzle chamber 42 inside the nozzle 40, which nozzle chamber 42 is directly connected to the feed channel 80. This third temperature control device 2" comprises a heating device 4", which is implemented here by means of heating elements 85. The heating elements 85 can, for example, be configured as an annular heating element 85 in order to limit the nozzle chamber 42 to the outside or relative to the housing 11. The heating elements 85 could, however, also be arranged in the housing 11 itself. The third temperature control device 2" can furthermore comprise a cooling device 3" (not shown here).

In the embodiment shown here, the respective temperature control devices 2, 2', 2" are configured and arranged in the dosing system 1 in order to continuously control the dosing material to a respective specific (target) temperature from provision, for example, from the time the dosing material cartridge 70 is coupled to the housing 11 until it is discharged from the nozzle 40. This means that the temperature zones assigned to the respective temperature control devices 2, 2', 2" are directly adjacent to one another. This is particularly clear in FIG. 2.

FIG. 2 shows parts of a dosing system according to another embodiment of the invention. The dosing system 1 here comprises three temperature zones 6, 6', 6". A first temperature zone 6 is assigned to the dosing material reservoir 70, wherein the temperature zone 6 completely encompasses the dosing material reservoir 70. The dosing material reservoir 70 can also be configured larger, in contrast to what is shown here. Substantially all of the dosing material in the dosing material reservoir 70 can be controlled by means of the assigned temperature control device 2 or the cooling device 3. The cooling device 3 substantially corresponds to that shown in FIG. 1 and comprises a cooling channel 73 which is arranged in the wall of the cartridge receiving unit 72 and which helically surrounds the cartridge 70. However, a feed device for cooling medium is arranged here in the region of a cover of the cartridge receiving unit 72 and is connected to the actual cooling channel 73 by means of a short (vertical) connecting channel.

The first temperature zone 6 assigned to the dosing material reservoir 70 directly adjoins a second temperature zone 6' assigned to the feed channel 80 in the region of a temperature zone boundary 8. The temperature control device 2' assigned to the second temperature zone 6' is configured to control substantially the entire dosing material in the feed channel 80. The dosing material flows through the feed channel 80 in a direction RD.

The second temperature control device 2' comprises a cooling device 3' which corresponds to the structure of the second cooling device 3' (assigned to the feed channel) from FIG. 1 and is therefore not explained in more detail here. In contrast to FIG. 1, however, here a coupling point 83 is coupled to an external cooling medium supply line 97' in order to supply the cooling channel 82 with a precooled cooling medium in a flow direction RM.

The temperature control device 2' assigned to the second temperature zone 6' further comprises a heating device 4' having a heating cartridge 85, which here is arranged above the feed channel 80.

The second temperature zone 6' directly adjoins a third temperature zone 6" assigned to the nozzle 40 in the region of a further temperature zone boundary 8'. As soon as the dosing material flowing in the direction of RD passes this temperature zone boundary 8', thus, enters the nozzle chamber 42, the dosing material is controlled by means of the third temperature control device 2" assigned to the nozzle, for example, heated to a dosing material-specific processing temperature. Continuous, "gap-free" control of the dosing material in the dosing system is possible according to this embodiment of the invention.

FIG. 3 shows a subsection of a fluidic unit according to a further embodiment of the invention. A temperature control device 2' having a cooling device 3' and a heating device 4' is assigned to a feed channel 80 here.

In contrast to FIGS. 1 and 2, the cooling device 3' here comprises two separately designed cooling channels 82', 82" which extend on two opposite sides of the feed channel 80. In the top view in FIG. 3, a first cooling channel 82' runs in the wall 81 to the left or below the feed channel 80 and a second cooling channel 82" in the wall 81 to the right or above the feed channel 80. The cooling channels can originate in a common feed opening. In contrast to FIG. 1, the cooling channels 82', 82" therefore do not enclose the feed channel 80 in a helical manner here, but run substantially in a straight line (apart from a kink) along the feed channel 80.

The region of the wall 81 of the feed channel 80 (between the two cooling channels 82', 82") that is not in direct operative contact with the cooling device 3' is at least partially encompassed by a heating device 4'. The heating device 4', here a number of heating wires 86', is directly supported on the wall 81 from the outside and can therefore feed heat to the dosing material in the feed channel 80 in a targeted manner.

The feed channel 80 furthermore comprises four temperature sensors 88', which are arranged in different regions on an inside of the wall 81. The temperature sensors 88' can feed a control unit of the dosing system (see FIG. 6) with a temperature of the dosing material in different regions of the dosing system as an input parameter for controlling the temperature.

In FIG. 3, it is particularly clear that the temperature control device 2' (like the other temperature control device of the dosing system) is configured to cool and also to heat the dosing material in an assigned temperature zone within the context of controlling the temperature simultaneously ("overlapping regulation").

FIG. 4 shows a fluidic unit according to a further embodiment of the invention. In contrast to FIG. 3, the temperature control device 2' assigned to the feed channel 80 here comprises a cooling device 3' having only one cooling channel 82' which (in a top view) runs to the left or below the feed channel 80.

The heating device 4' of the temperature control device 2' comprises a number of separately activatable heating cartridges 85 which are coupled to the control unit by means of separate heating connection cables 87. The heating cartridges 85 are arranged, on the one hand, in direct proximity to the feed channel 80 and can, for example, directly adjoin the wall 81 (here in the region above the feed channel 80). On the other hand, the heating cartridges 85 can also be arranged in the frame part 45 at a distance from the feed channel 80, wherein the cooling channel 82' can run between the heating cartridges 85 and the feed channel 80.

FIG. 5 shows a fluidic unit according to a further embodiment of the invention. In contrast to FIGS. 1 to 4, the cooling device 3' here does not comprise a flowing, precooled cooling fluid, but instead a stationary cold source integrated into the fluidic unit 30, here a Peltier element 99. The Peltier element 99 is arranged here directly in a wall 81 of the feed channel 80. The Peltier element 99 can be activated by the control unit by means of connection cables 89 to control the cooling capacity.

The Peltier element 99 can, on the one hand, be used to actively cool the dosing material in the feed channel 80. On the other hand, the same Peltier element 99 can also be used to heat the dosing material in the feed channel 80. An electric current in the Peltier element 99 has the effect of (actively) cooling a region or a side of the Peltier element 99, while an opposite side of the Peltier element 99 is heated. The Peltier element 99 thus forms the cold side and a warm side.

Depending on requirements, a direction of an electrical current flowing through the Peltier element 99 can be selected so that one side of the Peltier element 99, for example, a side facing the feed channel 80, is either cooled or heated. Thus, the dosing material in the feed channel 80 can either be cooled or even heated by means of just one Peltier element 99, as desired. The Peltier element 99 can thus be operated either as a cold source or as a heating device. Correspondingly, due to the different operating modes of the Peltier element 99, a separate heating device could in principle be dispensed with.

For particularly effective cooling of the dosing material by means of the Peltier element 99, the Peltier element 99 can preferably be arranged in the fluidic unit 30 such that the heat generated during operation of the Peltier element 99 can be dissipated as effectively as possible from the Peltier element 99. For this purpose, the "heat generating" side of the Peltier element 99 (here the side pointing away from the feed channel 80) can experience flow from outside the dosing system, for example, with compressed room air.

In spite of the different operating modes of the Peltier element 99, the temperature control device 2' here comprises a separate heating cartridge 85, which (in a top view of the feed channel 80) is arranged on a side of the feed channel 80 opposite the Peltier element 99.

The two "control components" 85, 99 are arranged "offset" here, based on the direction of flow RD of the dosing material in the feed channel 80. The case shown in FIG. 5 could show a feed channel 80 in the region shortly before the feed channel 80 opens into the nozzle. By means of the Peltier element 99 it is, for example, on the one hand, possible to cool the dosing material up to a defined region of the feed channel 80, for example, until reaching the right end of the Peltier element 99.

Since the dosing material in the nozzle (not shown) is typically heated to a processing temperature, it can be advantageous to end the cooling of the dosing material already in a region of the feed channel 80 shortly before the nozzle and instead to begin with a "precontrol" of the dosing material, for example, by means of the heating cartridge 85. Correspondingly, the temperature control device 2' can be configured, as shown here, such that only cooling of the dosing material takes place in a first subregion of the temperature zone, wherein pure heating of the dosing material takes place in a second, here "downstream" subregion of the temperature zone.

FIG. 6 schematically shows the structure of a temperature control system 7 according to an embodiment of the dosing system.

A control unit 50 activates a cold source 95, for example, a compression refrigeration machine 95, as a function of at least one input parameter of the dosing system 1 so that a cooling medium is cooled to a specific (first) temperature. The cooling medium, for example, compressed room air, is supplied to the refrigeration machine 95 by means of a compressed air supply 90. The cooling medium emerging from the compression refrigeration machine 95 has already been cooled to a temperature below the ambient temperature of the dosing system 1 and reaches two (parallel) downstream vortex tubes 93, 93' by means of suitable insulated lines.

The two vortex tubes 93, 93' are configured to cool the pre-controlled cooling medium to a final (target) temperature in a targeted manner. The two vortex tubes 93, 93' can be activated separately by means of the control unit 50 in order to cool the cooling medium to different (target) temperatures.

To regulate the cooling capacity, each of the two vortex tubes 93, 93' comprises a controllable regulating valve 94, 94' in the region of a hot air outlet HAW of the respective vortex tube 93, 93'. Both the temperature and the (volume) flow of the cooled cooling medium ("cold air component") can be regulated by means of the valve 94, 94'. In principle, opening the valve 94, 94' leads to a reduction in the flow as well as the temperature of the cooled air emerging from the respective vortex tube 93, 93'. The cooled cooling medium leaves the respective vortex tube 93, 93' at a cold air outlet of the vortex tube 93, 93' in a direction RM. A "hot air component" of the respective vortex tube 93, 93' is led away from the vortex tube 93, 93' by means of the respective hot air outlet HAW. To regulate the respective volume flow of the cooling medium entering the vortex tube 93, 93', a separate proportional valve 92, 92' can be connected upstream of the respective vortex tube 93, 93', the proportional valve being able to be activated by means of the control unit 50.

In the embodiment of the temperature control system 7 shown here, the precooled cooling medium of a first (here left) vortex tube 93 is used to control the temperature of a temperature zone assigned to the dosing material cartridge 70. The cooling medium enters a cooling channel 73 for cooling the dosing material in the cartridge 70 by means of a cooling medium supply line 97 which, on the one hand, is coupled to the vortex tube 93 and, on the other hand, to a coupling point of a cartridge receiving unit 72. The cooling medium leaves the cooling channel 73 by means of a cooling medium discharge line 98 in a region of a hot air outlet HAD of the dosing system. A controllable pressure reducer 96 is optionally provided here between the vortex tube 93 and the cooling channel 73.

The cooling medium emerging from the second (here on the right) vortex tube 93' is provided for control of a temperature zone assigned to the feed channel (not shown) of the fluidic unit 30. The cooling medium enters the feed channel by means of a separate cooling medium supply line 97' into a cooling channel 82 for cooling the dosing material. Here, too, an optional pressure reducer 96' is provided between the vortex tube 93' and the cooling channel 82. Due to the separately operated (second) vortex tube 93', the dosing material in the feed channel can be controlled to a different, preferably higher, (target) temperature than the dosing material in the cartridge 70. The cooling medium leaves the cooling channel 82 by means of a separate cooling medium discharge line 98'.

In FIG. 6, the cold compression system 95 interacts with two cooling devices 3, 3' of the dosing system 1. In the case depicted here, the respective cooling devices 3, 3' for cooling the dosing material in the cartridge 70 or in the feed channel are implemented by means of separate sub-cooling circuits 3, 3' which are each coupled separately to the cold compression system 95. This means that the cooling device 3 assigned to the dosing material reservoir 70 and the cooling device 3' assigned to the feed channel jointly use the cold provided by the cold compression system 95.

The cooling device 3 assigned to the dosing material reservoir 70 comprises, in addition to the cooling channel 73, a coupling point for a cooling medium supply line 97 and such a feed 97, also a separate vortex tube 93. Furthermore, the sub-cooling circuit 3 is, as mentioned, coupled to the cold compression system 95 in order to use the cold provided. In a corresponding manner, the cooling device 3' assigned to the feed channel also comprises a cooling channel 82, a coupling point having a cooling medium supply line 97 and its own vortex tube 93' and is also (separately) coupled to the cold compression system 95.

In order to be able to operate the two sub-cooling circuits 3, 3' separately, thus, in order to be able to individually determine the cooling of the respectively assigned temperature zone, a volume flow of the cooling medium in a respective sub-cooling circuit 3, 3' can be controlled by the control unit 50 by means of the assigned proportional valve 92, 92' and/or the temperature of the cooling medium in a respective sub-cooling circuit 3, 3' can be controlled by the control unit 50 by means of the regulating valve 94, 94' of the respective vortex tube 93, 93'. In the embodiment shown here, each of the two cooling devices 3, 3' comprises two different cold sources 55, 93 and 55, 93'. It is therefore a multi-part cold source.

In order to achieve a control of a respective temperature zone that is as stable as possible, and particularly less susceptible to failure, the temperature control device 2 assigned to the dosing material reservoir 70 and the temperature control device 2' assigned to the feed channel each comprise a separate heating device 4, 4', which here is implemented by means of a respective heating wire 86, 86'. Depending on the activation by the control unit 50, the dosing material in the cartridge 70 and/or in the feed channel can be controlled using the concept of "overlapping regulation".

The temperature control device 2" assigned to the nozzle 40 also comprises a heating device 4", here in the form of a heating wire 86", in order to heat the dosing material in the nozzle 40 to a processing temperature. The individual heating devices 4, 4', 4" of the different temperature control devices 2, 2', 2" can be activated separately by the control unit 50 by means of heating connection cables 87.

The dosing system 1 further comprises a number of temperature sensors 88, 88' in order to detect a temperature of the dosing material in the cartridge 70 and in the feed channel. In contrast to what is shown here, a number of temperature sensors could also be assigned to the nozzle 40 or the nozzle chamber. The corresponding measurement data are supplied separately to the control unit 50 as input parameters by means of temperature sensor connection cables 52.

As a function of these or further input parameters, the control unit 50 can calculate or carry out temperature management of the dosing system in order to carry out the most advantageous possible control of the dosing material in the different temperature zones. For this purpose, the control unit 50, using corresponding control signals, can act upon the cold compression system 95, the respective proportional valves 92, 92', the respective vortex tubes 93, 93' or the regulating valves 94, 94', the respective pressure reducers 96, 96', the respective heating devices 4, 4', 4" and optionally further components.

The actuators described above, thus, the controllable compression refrigeration machine 55, the proportional valves 92, 92', the pressure reducers 96, 96' and the controllable regulating valves 94, 94', can be used individually or in addition. The shown arrangement of the basic temperature control system 7 thus shows an almost maximum stage of extension in order to describe the individual components in their function.

Finally, it is pointed out once again that the dosing systems described in detail above are merely embodiments which can be modified in the most varied of ways by the person skilled in the art without departing from the scope of the invention. For example, a single cooling device can also comprise a plurality of vortex tubes. Alternatively or additionally, a cooling device can also comprise a plurality of cold compression lengths. Furthermore, the use of the indefinite article "a" or "an" does not exclude the possibility that the relevant characteristics can also be present several times.

LIST OF REFERENCE SYMBOLS

1 dosing system
2, 2', 2" temperature control device
3, 3', 3" cooling device
4, 4', 4" heating device
5 dosing device
6, 6', 6" temperature zone
7 temperature control system
8, 8' temperature zone boundary
10 actuator unit
11 housing
11*a* (first) housing part
11*b* (second) housing part
12 actuator chamber
13 action chamber
14 movement mechanism
15 breakthrough
16 lever
17 lever contact surface
18 lever bearing
19 actuator spring
20 pressure piece
21 feed opening/actuator chamber
22 discharge opening/actuator chamber
23 fixing screw
30 fluidic unit
31 tappet
32 tappet tip
33 tappet head
34 tappet contact surface
35 tappet spring
36 tappet seal
37 tappet bearing
40 nozzle
41 nozzle opening
42 nozzle chamber
43 sealing seat
44 coupling point/housing
45 frame part
50 control unit
51 control cable
52 temperature sensor connection cable
60 piezo actuator
61 contact pin
62 actuator control connections
70 dosing material cartridge
71 cartridge wall
72 cartridge receiving unit
73 cooling channel/cartridge
74 cartridge receiving unit wall
75 feed opening/cartridge
76 discharge opening/cartridge
77 coupling point/cartridge
80 feed channel
81 feed channel wall
82, 82', 82" cooling channel/feed channel
83 feed opening/feed channel
84 discharge opening/feed channel
85 heating cartridge
86, 86', 86" heating wire
87 heating connection cable
88, 88' temperature sensor
89 Peltier element connection cable
90 compressed air supply
92, 92' proportional valve
93, 93' vortex tube
94, 94' valve vortex tube
95 cold compression system
96, 96' pressure reducer
97, 97' cooling medium supply line
98, 98' cooling medium discharge line
99 Peltier element
HAW hot air outlet vortex tube
HAD hot air outlet dosing system
K tilt axis
R discharge direction
RD flow direction dosing material
RM flow direction cooling medium

The invention claimed is:

1. A dosing system (1) for a dosing material having a dosing device (5) with a housing (11) comprising a feed channel (80) for dosing material, a nozzle (40), a discharge element (31) and an actuator unit (10) coupled to the discharge element (31) and/or the nozzle (40), and having a dosing material reservoir (70) coupled to the housing (11) or integrated into the housing (11), the dosing system (1) having a plurality of temperature control devices (2, 2', 2") which are each assigned to different temperature zones (6, 6', 6") of the dosing system (1) in order to control the temperature zones (6, 6', 6") to respectively different target temperatures, at least one first temperature zone (6) being assigned to the dosing material reservoir (70) and at least one second temperature zone (6") being assigned to the nozzle (40), and at least the temperature control device (2) assigned to the dosing material reservoir (70) comprising a cooling device (3, 3', 3") having a cold source (93, 93', 95, 99).

2. The dosing system according to claim 1 [[16]], wherein the cold source (95) of the cooling device (3, 3', 3") is configured to cool a cooling medium of the cooling device (3, 3', 3") to a predeterminable temperature and/or wherein the cold source (93, 93') comprises at least one vortex tube (93, 93').

3. The dosing system according to claim 1, having a control unit (50) and/or regulating unit (50) to control and/or to regulate the temperature control device (2, 2', 2").

4. The dosing system according to claim 3, wherein the control unit (50) and/or regulating unit (50) is configured to control and/or regulate the temperature control device (2, 2', 2") for controlling the temperature of the dosing material based on at least one input parameter.

5. The dosing system according to claim 4, wherein the temperature control device (2, 2', 2") is assigned to at least one temperature sensor (88, 88') in the dosing system (1) for generating the input parameter.

6. The dosing system according to claim 4, wherein the at least one input parameter comprises a volume flow and/or a temperature and/or a viscosity.

7. The dosing system according to claim 3, wherein the control unit (50) and/or regulating unit (50) regulates the dosing material in the assigned temperature zone (6, 6', 6") to a target temperature.

8. The dosing system according to claim 1, wherein the temperature control device (2, 2', 2") comprises a heating device (4, 4', 4").

9. The dosing system according to claim 8, wherein the temperature control device (2, 2', 2") is assigned a control unit (50) and/or regulating unit (50) which is configured to separately control and/or to separately regulate the cooling device (3, 3', 3") and the heating device (4, 4', 4") of the temperature control device (2, 2', 2").

10. The dosing system according to claim 8, wherein the cooling device (3, 3', 3") and the heating device (4, 4', 4") of the temperature control device (2, 2', 2") are spatially separated from one another.

11. The dosing system according to claim 8, wherein the temperature control device (2") assigned to the nozzle (40) comprises the heating device (4").

12. The dosing system according to claim 1, wherein the dosing system (1) comprises at least one further temperature control device (2') which is assigned to a third temperature zone (6'), the third temperature zone being assigned to the feed channel (80) of the dosing system (1).

13. The dosing system according to claim 1, wherein the dosing material reservoir (70) comprises a dosing material supply container (70).

* * * * *